US011114257B2

(12) United States Patent
Wu

(10) Patent No.: US 11,114,257 B2
(45) Date of Patent: Sep. 7, 2021

(54) METHODS AND APPARATUS FOR DC ARC DETECTION/SUPPRESSION

(71) Applicant: Yazaki North America, Inc., Canton, MI (US)

(72) Inventor: Yuanyuan Wu, Canton, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 437 days.

(21) Appl. No.: 15/947,602

(22) Filed: Apr. 6, 2018

(65) Prior Publication Data

US 2019/0311864 A1 Oct. 10, 2019

(51) Int. Cl.
*H01H 9/54* (2006.01)
*H01H 9/30* (2006.01)
*H01H 33/04* (2006.01)

(52) U.S. Cl.
CPC ..... *H01H 9/542* (2013.01); *H01H 9/30* (2013.01); *H01H 9/541* (2013.01); *H01H 33/04* (2013.01); *H01H 2009/546* (2013.01)

(58) Field of Classification Search
CPC .... H01H 9/542; H01H 2009/546; H01H 9/30; H01H 33/04; H01H 33/596
See application file for complete search history.

(56) References Cited

U.S. PATENT DOCUMENTS 3,982,137 A 9/1976 Penrod
4,438,472 A * 3/1984 Woodworth ..... H01H 9/542 307/134
4,658,320 A * 4/1987 Hongel ..... H01H 9/542 361/13

(Continued)

FOREIGN PATENT DOCUMENTS

CN 1072385 C 10/2001
EP 0102442 A2 3/1984

(Continued)

OTHER PUBLICATIONS

The extended European Search Report for the related European Patent Application No. 18194768.0 dated Mar. 22, 2019.

(Continued)

*Primary Examiner* — Fred E Finch, III
(74) *Attorney, Agent, or Firm* — Kenealy Vaidya LLP

(57) ABSTRACT

Some embodiments are directed to an apparatus for detecting and suppressing DC electric arcs at a component, and are particularly adapted for vehicle wiring harnesses. The apparatus can include a detector circuit electrically connected to input and output terminals so as to be electrically connected in parallel to the component, the detector circuit being configured to detect a significant voltage spike across the component upon the component actuating between open and closed positions. The detector circuit can also be configured to transmit a control signal upon detecting the significant voltage spike. The detector circuit can include multiple circuit elements, enabling both the detection of the significant voltage spike and the transmission of the control signal, that are directly electrically connected to each other. A switching circuit conducts electricity from the power source side of the component to the load side of the component upon receipt of the control signal.

15 Claims, 5 Drawing Sheets

(56) References Cited

U.S. PATENT DOCUMENTS

| | | | | |
|---|---|---|---|---|
| 5,081,558 | A * | 1/1992 | Mahler | H01H 9/542 361/13 |
| 5,652,688 | A | 7/1997 | Lee | |
| 8,619,395 | B2 | 12/2013 | Henke | |
| 9,423,442 | B2 | 8/2016 | Henke | |
| 9,508,501 | B2 | 11/2016 | Henke | |
| 2003/0193770 | A1 * | 10/2003 | Chung | H01H 9/542 361/118 |
| 2004/0052011 | A1 | 3/2004 | King et al. | |
| 2007/0139831 | A1 * | 6/2007 | Wright | H01H 59/0009 361/2 |
| 2008/0112097 | A1 * | 5/2008 | Maharsi | H01H 9/542 361/13 |
| 2009/0014631 | A1 | 1/2009 | Noguchi | |
| 2010/0007997 | A1 | 1/2010 | Kao | |
| 2014/0091059 | A1 | 4/2014 | Henke | |
| 2014/0091060 | A1 | 4/2014 | Henke | |
| 2014/0091061 | A1 | 4/2014 | Henke | |
| 2014/0091808 | A1 | 4/2014 | Henke | |
| 2016/0190791 | A1 * | 6/2016 | Sim | H02H 3/087 361/93.6 |
| 2018/0006447 | A1 * | 1/2018 | Morita | H01H 9/542 |
| 2019/0279830 | A1 * | 9/2019 | Omori | H01H 9/30 |
| 2019/0348237 | A1 * | 11/2019 | Morita | H01H 33/59 |

FOREIGN PATENT DOCUMENTS

| | | | |
|---|---|---|---|
| FR | 2738664 | A1 | 3/1997 |
| WO | 2008153960 | A1 | 12/2008 |

OTHER PUBLICATIONS

The Chinese Office Action for the related Chinese Patent Application No. 201811045692.6 dated Jan. 7, 2021.

* cited by examiner

METHODS AND APPARATUS FOR DC ARC DETECTION/SUPPRESSION

BACKGROUND

Some embodiments are directed to methods and apparatus for DC arc detection and/or suppression, such as in the context of automotive wire harnesses, however it is envisioned that the disclosed embodiments can be applied in any other context where use of the disclosed technology is beneficial.

An electric arc (also known as an arc discharge) is an electrical breakdown of a gas that produces an ongoing electrical discharge. Current passing through a medium produces plasma, which may generate visible light. An arc discharge involves a lower voltage than a glow discharge, and is based on thermionic emission of electrons from the electrodes supporting the arc.

An arc is distinguished from a glow discharge partly by the approximately equal effective temperatures of both electrons and positive ions, however glow discharges involve ions with much less thermal energy than the electrons. More specifically, an electric arc differs from a glow discharge in that the current density is high, and the voltage drop within the arc is low. In fact, the current density at a cathode can be as high as one megaampere per square centimeter.

An electric arc provides an electric discharge with the highest current density, and the maximum current through an arc is limited only by the external circuit. The breakdown voltage of the electrode gap is a combined function of the pressure, distance, and temperature between electrodes and type of gas surrounding the electrodes.

An electric arc may occur either in direct current (DC) circuits or in alternating current (AC) circuits, and can be initiated by two electrodes initially in contact and drawn apart. For example, an arc can be created by separating electrical contacts in switches, relays or circuit breakers. An electric arc is a continuous discharge, while a similar electric spark discharge is momentary.

Arcing can also occur when a low resistance channel (foreign object, conductive dust, moisture, etc.) forms between places with different voltages. The conductive channel can facilitate formation of an electric arc. The ionized air has high electrical conductivity approaching that of metals, and it can conduct extremely high currents, causing a short circuit and tripping protective devices (fuses and circuit breakers). A similar situation may occur when a lightbulb burns out and the fragments of the filament pull an electric arc between the leads inside the bulb, leading to overcurrent that trips the breakers.

Electrical resistance along the continuous electric arc creates heat, which ionizes more gas molecules and the degree of ionization is determined by temperature. An electric arc has a non-linear relationship between current and voltage. Once the arc is established, such as by progressing from a glow discharge or alternatively by momentarily touching the electrodes and then separating them, increased current results in a lower voltage between the arc terminals. The negative resistance causes positive impedance, i.e., an electrical ballast, to be placed in the circuit to maintain a stable arc. Uncontrolled electrical arcs in apparatus can be incredibly destructive because an arc draws an increasing current from a fixed-voltage supply until the apparatus is damaged or destroyed.

SUMMARY

Unintended or undesired arcing can occur in many different contexts, including with automotive electrical components and wiring, such as with regard to an automotive wire harness. Electric arcing in this context can have detrimental effects on electric power transmission, distribution systems and electronic equipment. Devices that may cause arcing include switches, circuit breakers, relay contacts, fuses and poor cable terminations. When an inductive circuit is switched off, the current cannot instantaneously change to zero, and so a transient arc may be formed across the separating contacts. If a circuit has sufficient current and voltage to sustain an arc formed outside of a switching device, then the arc can cause damage to equipment. This damage can take the form of melting of conductors, destruction of insulation, fire, etc.

Electrical arcs also form new chemical compounds from the air surrounding the arc, such as oxides of nitrogen and ozone. These chemicals can be produced by high-power contacts in relays and motor commutators, and are corrosive to adjacent metal surfaces. Arcing also erodes the surfaces of the contacts, wearing them down and creating high contact resistance when closed.

Undesired arcing at electrical contacts of contactors, relays and switches can be reduced by contact arc suppressors and RC Snubbers, or through techniques including immersion in transformer oil, dielectric gas or vacuum, arc chutes, magnetic blowouts, pneumatic blowouts, sacrificial arcing contacts, damping materials to absorb arc energy, either thermally or through chemical decomposition. Arcing can also be reduced, suppressed, or eliminated using a MCU based closed loop control that disables the power source, and other techniques that use capacitors, opto-couplers and triacs based control circuits.

However, the related art arc suppression techniques are subject to one or more disadvantages, such as in automotive applications. These disadvantages include but are not limited to exhibiting performance limitations, being costly, complicated, difficult to install, a lack of durability and/or longevity, etc.

It may therefore be beneficial to provide methods and apparatus for DC arc detection and/or suppression, such as for automotive applications that address or solve one or more of the above disadvantages of the related art. Some of the disclosed embodiments are specifically directed to DC arc detection and/or suppression methods and apparatus exhibiting enhanced performance and cost effectiveness in automotive applications.

In general, some embodiments include a circuit that is configured and usable to detect a DC arcing condition and to provide a by-pass for the arcing energy, which yields various advantages, such as protecting automotive wire harness components, e.g., connectors, contact connections, etc.

In some embodiments, voltage is captured when the terminal contacts are open or closed and shaped into a time duration pulse, which enables the FET or bypass circuit to be able to shunt the arc energy for a set time that is helpful or necessary to reduce or suppress the arc. The circuit then shuts off so that no (or a reduced amount of) additional power is drawn for the circuit. Some of these embodiments provide a higher performance (such as a 50% improvement in performance as compared to the related art), and/or a reduced manufacturing cost (such as a 70% reduction as compared to the related art).

Some embodiments are therefore directed to an apparatus for detecting and suppressing DC electric arcs at a component that connects an electric power source to a load and that is configured to be actuable between an open position that impedes flow of electricity and a closed position that enables flow of electricity. The apparatus can include an input terminal electrically connected to a power source side of the component; and an output terminal electrically connected to a load side of the component. A detector circuit is electrically connected to the input and output terminals so as to be electrically connected in parallel to the component, the detector circuit being configured to detect a significant voltage spike across the component upon the component actuating between open and closed positions. The detector circuit is also configured to transmit a control signal upon detecting the significant voltage spike. The detector circuit includes multiple circuit elements, enabling both the detection of the significant voltage spike and the transmission of the control signal, that are directly electrically connected to each other. A switching circuit conducts electricity from the power source side of the component to the load side of the component upon receipt of the control signal.

In some embodiments, the significant voltage spike constitutes a voltage sufficient to cause electric arcing within the component.

In some embodiments, the detector circuit includes a capacitor that is directly electrically connected to the input terminal, and a resistor that is directly electrically connected to the capacitor at a side opposite from the input terminal, the resistor also being directly electrically connected to the output terminal. The resistor can provide at least 10 Kω impedance.

In some embodiments, the detector circuit includes a diode that is directly electrically connected to the capacitor at the side opposite from the input terminal, and a Zener diode that is directly electrically connected to the diode. The detector circuit can also include another resistor directly electrically connected to the Zener diode at a side opposite from the diode, the other resistor being directly electrically connected to the output terminal, such that the resistor and the Zener diode are in parallel relative to each other. The other resistor can provide an impedance that is substantially less than an impedance provided by the resistor.

In some embodiments, the switching circuit includes a solid state triggerable switch that is configured to receive the control signal from the detector circuit, and upon receipt of the control signal, to conduct electricity from the input terminal to the output terminal. The solid state triggerable switch can be a Field Effect Transistor (FET). The switching circuit can also include a diode electrically connecting the solid state triggerable switch to the input terminal, the diode being configured to limit current between the input terminal and the solid state triggerable switch. The solid state triggerable switch can be a Silicon Controlled Rectifier or an Opto-Electronic Switch.

Some embodiments are directed to a method for detecting and suppressing DC electric arcs at a component that connects an electric power source to a load and that is configured to be actuable between an open position that impedes flow of electricity and a closed position that enables flow of electricity. The method can include: electrically connecting an input terminal to a power source side of the component; electrically connecting an output terminal to a load side of the component; electrically connecting a detector circuit to the input and output terminals so as to be electrically connected in parallel to the component, the detector circuit being configured to detect a significant voltage spike across the component upon the component actuating between open and closed positions, the detector circuit also being configured to transmit a control signal upon detecting the significant voltage spike, the detector circuit including multiple circuit elements enabling both the detection of the significant voltage spike and the transmission of the control signal that are directly electrically connected to each other; and conducting electricity from the power source side of the component to the load side of the component upon a switching circuit receiving the control signal.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

1. Related Art Arc Suppression

Figure 1:
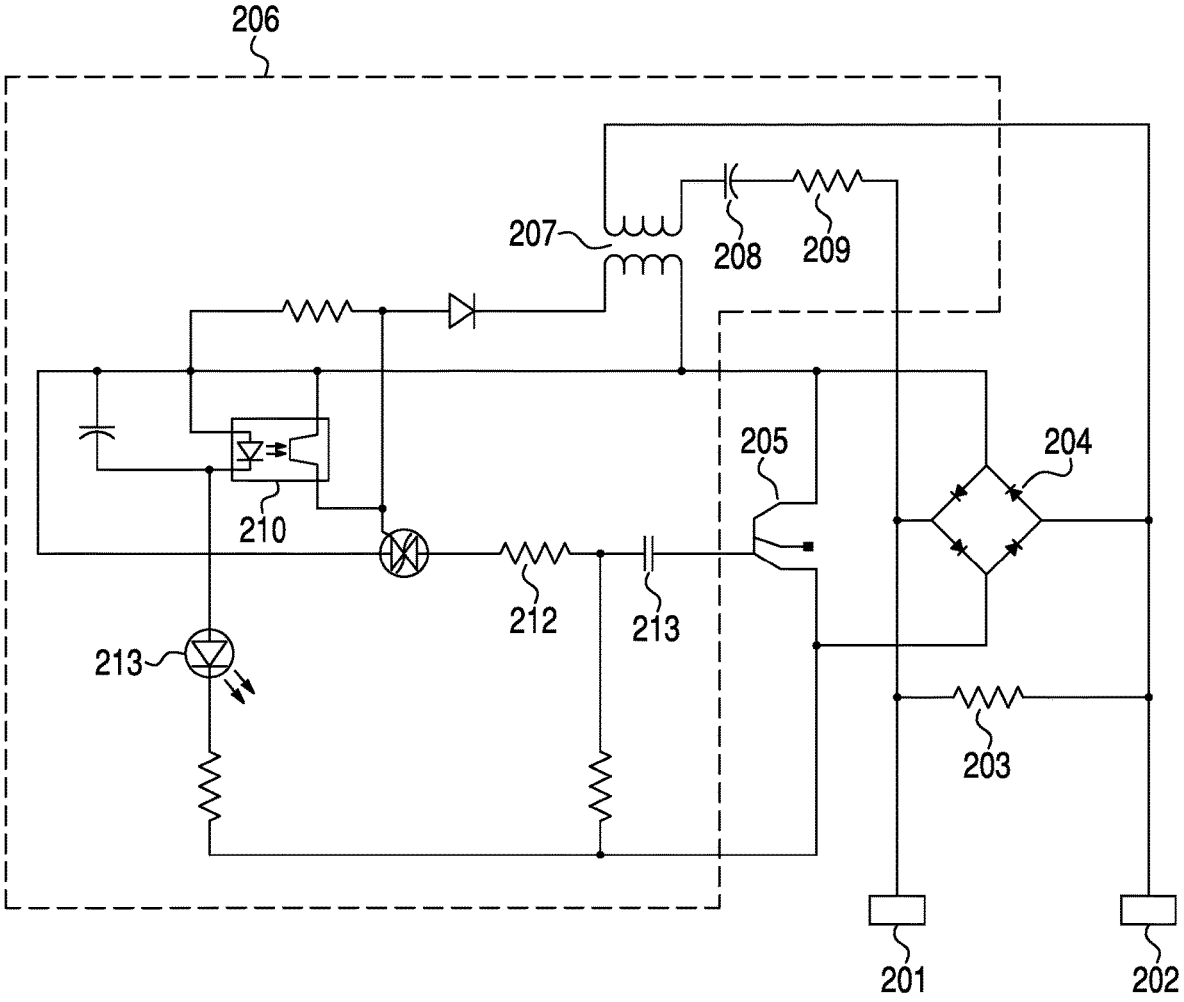
FIG. 1 Related Art
FIG. 1 is a schematic of a related art arc suppression apparatus.

FIG. 1 is a schematic of a related art arc suppression apparatus, which suppresses arcs for both AC and DC circuits. Two terminals 201 and 202 are bridged by a varistor 203 for surge protection and connected through a rectifier 204 to a switching element 205. The switching element 205 is triggered by a control circuit 206 whenever there is a risk of arcing. This effectively short-circuits the endangered mechanical connection through an electrical.

The control circuit 206 includes a transformer 207 to reduce the voltage from the protected connection. The transformer 207 is arranged in series with a capacitor 208 and resistor 209 to form an RC circuit. The output of this circuit then triggers an opto-isolator 210, the output of which is filtered by the RC circuit comprised of the resistor 212 and capacitor 213 to become the control signal for the switching element 205. A voltage change across the transformer 207 then drives the isolator 210 to trigger the switch 205, which short-circuits the connections and protects the physical contacts. This pulse also triggers a diagnostic LED 213 to indicate the circuit's operation. Externally, the terminals 201 and 202 will be connected across the protected device, for example by connection to terminals.

Figure 2:
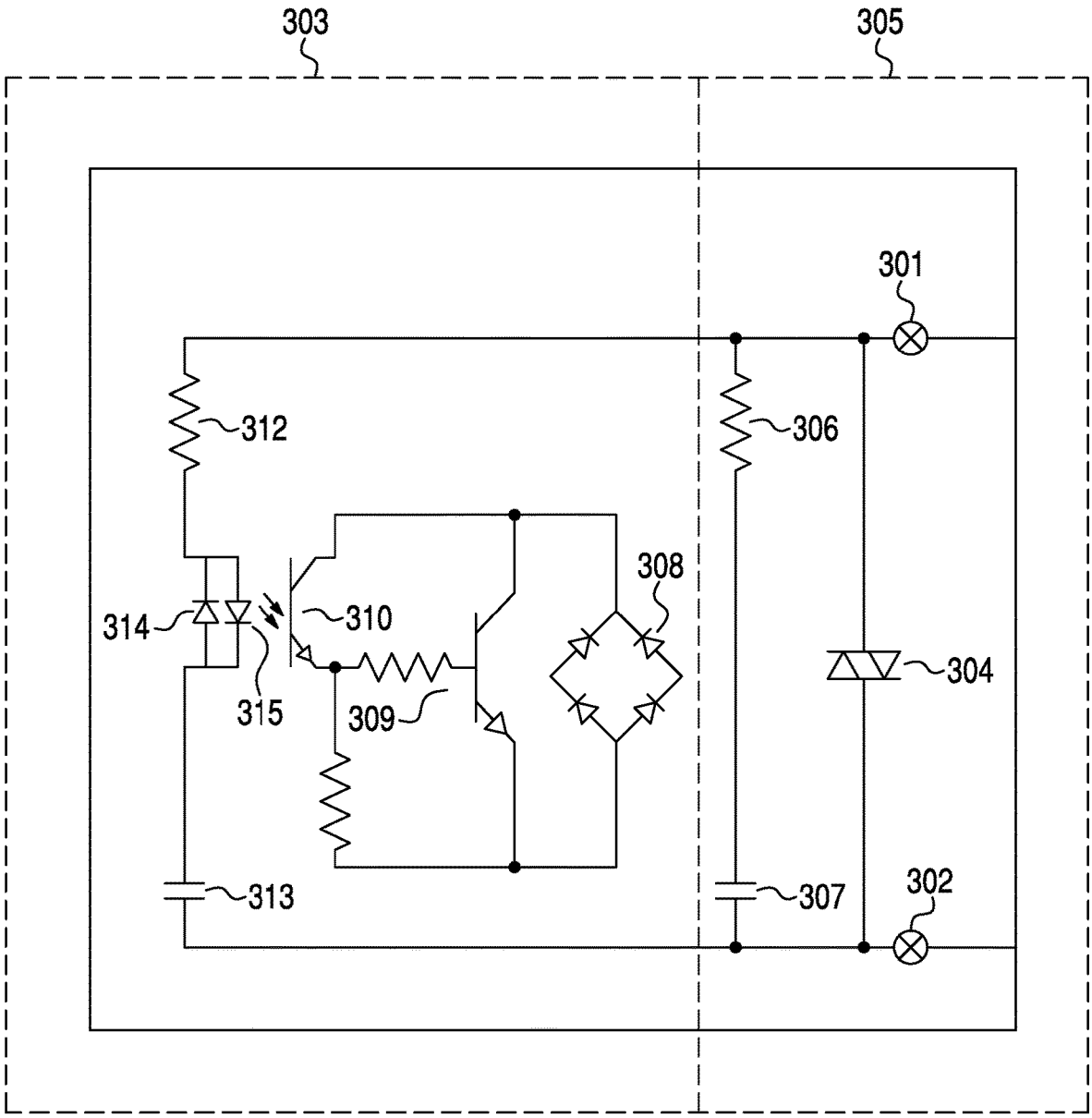
FIG. 2 Related Art
FIG. 2 is a schematic view of another related art arc suppression apparatus in a DC circuit.

FIG. 2 is a schematic of another related art arc suppression apparatus for a DC circuit. The terminals 301 and 302 are connect to other terminals. These terminals are then connected to a switching circuit 303 in parallel with a voltage regulator 304 and an RC snubber circuit 305, which includes a resistor 306 and a capacitor 307.

The switching circuit 303 includes a rectifier 308 bridging the terminals 301 and 302. The rectified output is switched by an NPN switching transistor 309, which is controlled by an IR detector 310.

The terminal 301 is also connected to a RC circuit that includes a limiting resistor 312, a differentiating and timing capacitor 313, and two IR emitting diodes 314 and 315 arranged in opposite directions. This serves as the control circuit for the solid-state switch.

When the contacts of the switch or relay 104 transition from closed to open, current flows through the capacitor 313, limited by the resistor 312. This current causes the IR emitting diode 315 to both charge the capacitor 313 and briefly emit light, which triggers the solid-state switch 303 to short-circuit the contacts of the relay or switch 104. In the other direction, when the switch or relay 104 transitions from open to closed, the capacitor 313 discharges and current flows through the IR emitting diode 314, which briefly emits light which triggers the solid-state switch 303 to short-circuit the contacts of the relay or switch 104.

2. Context of Arc Suppression Apparatus of Exemplary Embodiments

Some embodiments are directed to a two-terminal arc suppression apparatus designed to limit arcing across a range of intermittently conducting mechanical connections, including switches and relays as well as plugs, terminals, and components of cable assemblies where the possibility of an air gap (and the resultant arcing) is possible.

In a two-terminal arc suppression circuit, the terminals are used for both arc detection (or, more precisely, arc prediction) and arc suppression. In some embodiments, arc suppression is performed by providing an alternate, entirely electrical, path for current during the period that contacts are opening or closing. This reduces or avoids arcing between the contacts until they are far enough apart or in direct contact so that arcs and their damage are no longer possible.

The alternate electrical path for suppressing the arc is generally provided by some sort of electronic switch, for example a FET or TRIAC. The path needs to become active when the arc is occurring but inactive at other times to avoid either short-circuiting the load during operation or consuming power while the contacts are open. This is generally performed by arranging self-limiting circuits (usually involving a capacitor), which is only active for a short period during which contacts are closing or opening.

The parameters of these self-limiting circuits depend on the physical configuration of the contacts being protected and particularly the duration of the period when arcs are likely.

Figure 3:
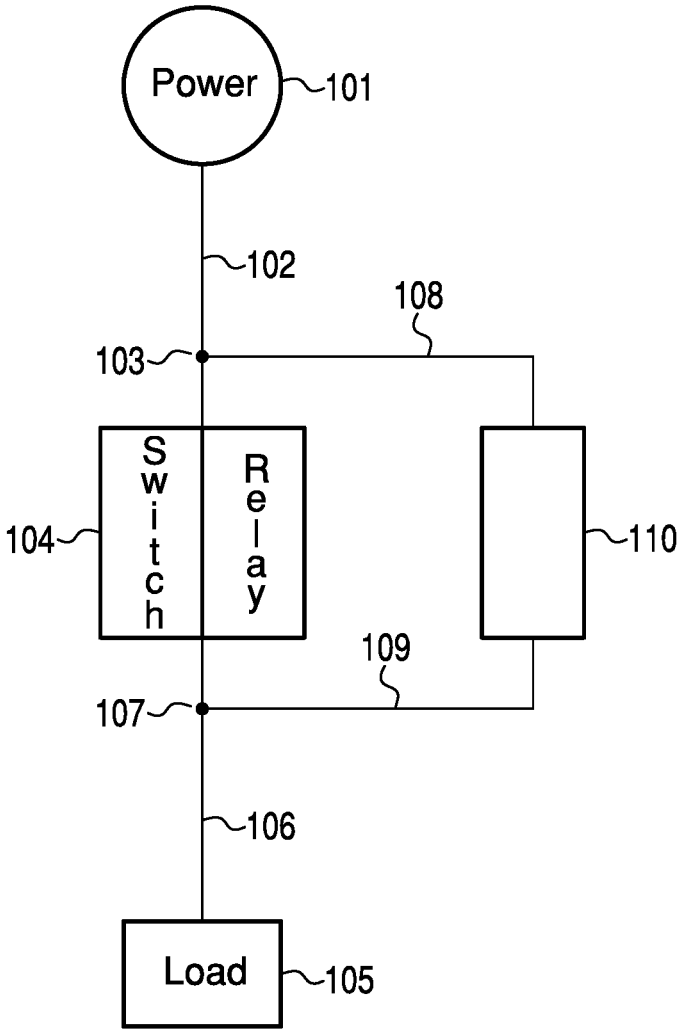
FIG. 3 is a schematic of an arc suppression apparatus in accordance with an exemplary embodiment of the presently disclosed subject matter, which is connected to switches and/or connectors that are protected thereby.

FIG. 3 is a schematic of an arc suppression apparatus in accordance with an exemplary embodiment, which is connected to switches and/or connectors that are protected thereby. A DC power source 101 is connected by a wire 102 to a terminal 103 of a mechanical switch, relay, or connector 104. A load 105 is connected by a wire 106 to the second terminal 107 of the switch, relay, or connector 104.

An embodiment of the invention (arc suppression apparatus) 110 is connected to terminal 103 by a wire 108 and to terminal 107 by a wire 109. The embodiment of the arc suppression apparatus 110 short circuits the switch or relay 104 when it transitions between open and closed states, avoiding the formation of damaging electrical arcs between the contacts in the switch or relay 104.

3. Overall Arc Suppression Apparatus of Exemplary Embodiments

Figure 4:
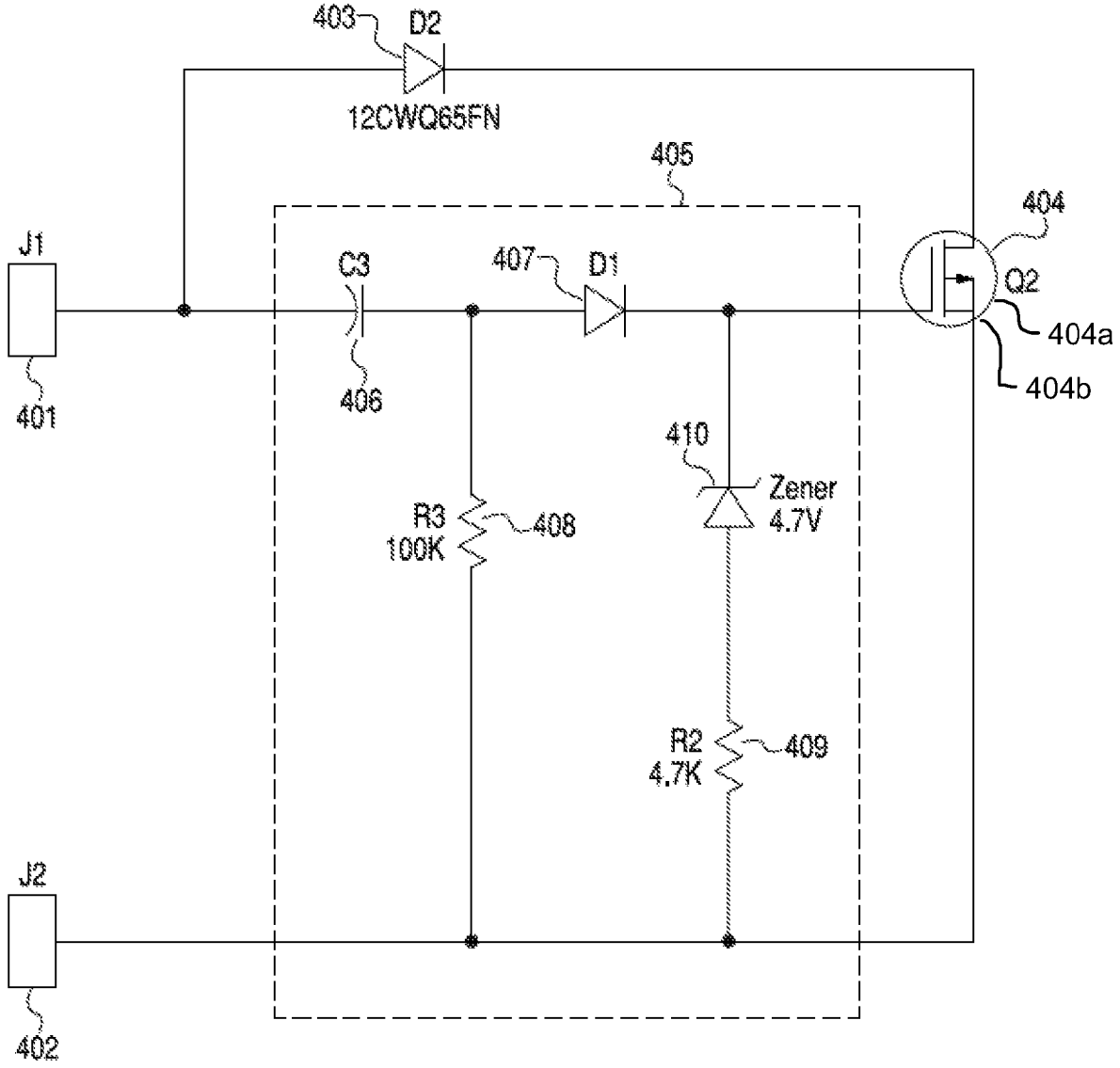
FIG. 4 is a schematic of an arc suppression circuit in accordance with an exemplary embodiment of the presently disclosed subject matter.

FIG. 4 is a schematic of an arc suppression circuit in accordance with an exemplary embodiment. The input terminal 401 is connected to a diode 403, which feeds into the source of a field emission transistor (FET) 404, a drain of which is connected directly to the output terminal 402. The terminals 401 and 402 are respectively connected to the terminals 103 and 107 in FIG. 3. The gate voltage for the FET 404 is generated and controlled by a separate circuit 405 across the terminals. This circuit includes a capacitor 406 connected to the gate input of the FET 404 through a diode 407. The capacitor 406 is also connected to the output terminal 402 through a high-impedance resistor 408. The diode 407 also connects to the output through a Zener diode 410 (polarized oppositely) and a resistor 409.

When the contacts of the switch or relay 104 transition from closed to open, high voltage current flows through the capacitor 406 and the diode 407 to the gate of the FET 404, which short-circuits the contacts of the switch or relay 401 until the capacitor is saturated. The capacitor 406 discharges when the contacts of 104 transition back from open to closed, again triggering the FET 404 to short circuit, protecting the contacts of the switch/relay/connector 104.

The terminal 401 serves to connect the inventive arc suppression apparatus 110 to the component (switch, relay, or connector) being protected. This requires a solid electrical connection in order for it (apparatus 110) to avoid being subject to arcing. The terminal 401 leads directly to both the control circuit for the switching element 404, and to the switching element itself through the diode 403.

Some embodiments include two distinct circuits connected only at the switching element 404. One circuit provides the path that short-circuits the protected component 401 during the period of arc suppression. Another circuit detects the precursors of arcing as the voltage increases across both the protected component 104 and the protective embodiment 110.

The terminal 401 connects to the switching element 404 through a diode 403. The diode 403 provides for current steering and over-voltage protection for the switching element 404. The presence of the diode is beneficial because the arc suppression circuit is active and activated by the high voltages associated with opening and closing of the protected contacts.

In the embodiment shown in FIG. 4, the switching element is a FET (Field Effect Transistor) which uses an electric field to allow or interrupt the flow of current from source to sink. This enables the switching element to be solid state and not subject to arcing. It also decouples the control circuit leading into the gate of the FET from the voltage and current flow when the circuit is active.

The sink of the FET leads directly to the output terminal 402, which is connected to the output of the component being protected 107. As with the input terminal 401, the output terminal provides a solid electrical connection to the output 107 of the protected component 104.

The control circuit of some embodiments is entirely separate from switched path, which short-circuits the component during the critical interval for arcing. The control circuit utilizes a capacitor 406 to specify the interval during which the switching element is active.

Arc detection can be challenging/complicated because it involves the identification of both the opening and the closing of contacts in the protected component 104. These events are electrically distinct. Closing a contact involves a change of zero voltage to operating voltage through a high voltage region as the contacts near one another. Opening the contacts of the protected component 104 has the opposite profile, involving a change from the operating voltage to zero voltage through a high voltage region as the contacts initially part.

The capacitor 406 operates differently in these two cases. When the contacts of 104 close, the capacitor charges up to its capacity, and current passes through until the capacitor is saturated. This current then feeds the gate of the switching element 404, enabling the path from 401 to 402, which suppresses the arc between closed contacts 104 and the risk of arcing has passed.

During normal operation with the contacts of 104 closed, the capacitor 406 remains saturated because there is no path for discharge, due to the high impedance resistor 408 and the opposing polarity Zener diode 410.

The circuit operates differently when the switch, relay, or contact transitions back from the closed to open state. The high voltage of this transition exceeds the breakdown voltage of the Zener diode 410 and current flows once again, activating the switching element 404 and short circuiting the protected component during the high voltage region where arcing would normally occur.

The Zener diode 410 is connected to the output terminal 402 through a resistor 409. Because the resistor 409 is of lower impedance than the resistor 408, current will flow primarily through that path, triggering the switching element.

Different calculations may be necessary for different operating voltages, because Zener diodes function differently at voltages below 5.6V (many electronic circuits) and above 5.6V (many automotive applications).

At still higher voltages, it may be beneficial for some embodiments to address the heat generated by the Zener diode during the high voltage period when the suppressor is active. A heat sink or other cooling provision may be used to address or ameliorate this issue.

The duration of the suppression period is controlled by the values of the timing capacitor 406 and the limiting resistors 408 and 409. These calculations may also consider the residual resistance of the diode during breakdown.

The chosen suppression period may be based on the characteristics of the protected component 104 as well as the typical operating scenarios for the system. For example, in a mechanical switch, the period during which the contacts are close enough to arc will be based on the size of the contacts, their relative geometry, and the mechanics of the switching mechanism. For example, if the contacts on the switch are near the fulcrum of a lever arm, the danger zone for arcing will be longer and the values for components 406, 408, and 409 should be adjusted accordingly.

On the other hand, in a mechanical connector, the geometry of the connector will constrain this duration because it is defined by how quickly the contacts are separated during connection or reconnection.

Determining these parameters may also take into account the phenomenon of "contact bounce," which is an issue for most or nearly all mechanical switches. This occurs when two physical contacts briefly separate and touch (or touch and separate) before settling into an open or closed state. To address contact bounce, the suppression duration, based on the values of the capacitor 406 and the resistors 408 and 409, may be increased. In practice, the actual contact bounce behavior of physical switches may be determined experimentally for the particular geometries and materials being used in the switch.

In the case of an electromechanical relay protected by some embodiments, the duration for arc suppression may depend on the magnetic and mechanical characteristics of the relay itself. This can include the electrical characteristics of the magnetic coil, the geometry and material composition of the armature, and the tensile and geometric properties of any springs or other components used to constrain the armature.

Yet another factor in determining the arc suppression duration is the mode of operation of the physical switch being protected. For example, in a manually operated switch, an operator may increase the effective duration of contact arcing by operating the switch slowly or keeping it in a meta-stable condition for an extended period. Because some embodiments are triggered by the high voltage regions that accompany the risk of arcing, it will still function in these cases, but it may "stutter" as the control circuit settles and is re-triggered. In these cases, the contact degradation and other effects of arcing may still occur while being reduced in severity.

Mechanical customization of the physical switching component may reduce some of these types of "operator errors," such as via the inclusion of springs, dogs, locks, or other physical limiters in the actual physical device.

4. Timing Diagram

Figure 5:
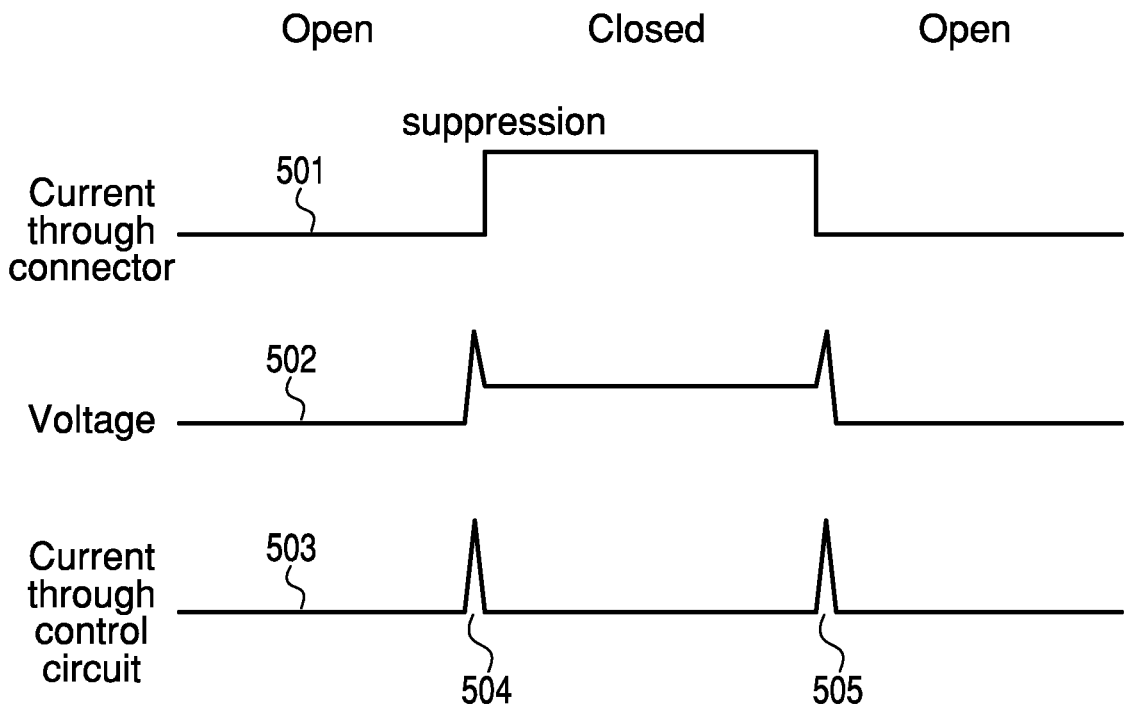
FIG. 5 is a timing diagram showing operation of an arc suppression circuit in accordance with an exemplary embodiment of the presently disclosed subject matter.

FIG. 5 is a timing diagram showing an exemplary operation of an arc suppression circuit in accordance with an exemplary embodiment. The first line 501 identifies current through the switch or connector 104. The second line 502 identifies the voltage across the control circuit 405 during transitions of the switch from open to closed. The third line 503 identifies the current through the control circuit during these transitions.

Current only flows through the control circuit 405 during the suppression intervals 504 and 505. These are periods of high voltage 502, when the voltage exceeds the breakdown voltage of the Zener diode 410. During these periods, voltage is applied to the gate of the FET 404 short-circuiting the contacts of the switch or connector 104 and reducing or avoiding arcing across the contacts.

The current for the gate of the FET 404 originates from the upstream power source 101 on the transition from closed to open, and from the charged capacitor 406 on the transition from open to closed.

5. Exemplary Advantages of Some Embodiments

The simple design of some embodiments and the low component count make it advantageous for inclusion in wiring harnesses for automotive and related applications, where there are large numbers of contacts or connectors (with need for arc suppression) throughout the vehicle body.

The passivity of the control circuitry of some embodiments during normal operation (when the contacts are not transitioning between open and closed states) enables a situation where the suppression of arcs does not require significant power and is particularly suitable to applications where it is important to reduce or minimize standing power.

The fact that the circuit of some embodiments is only operational during arc suppression increases its effective lifetime and the mean time between failures. This reduces both maintenance costs and operational reliability in systems where multiple contacts or switches need to be protected.

The simplicity of the design and the absence of bulky components of some embodiments enables a situation where the physical circuit can be encapsulated in many ways. For example, the circuit can be built into the physical casing of a switch or connector to provide protection for that circuit or connector in particular. This simplifies assembly and decreases production costs. The circuit can also be embodied as a clip-on component, which can be secured around connectors or terminals that may be especially prone (given mechanical or environmental stresses) to arcing.

In automotive applications, the compactness of some embodiments enables the suppression circuit itself to be placed close to the mechanical contacts being protected. This both reduces the overall cost of additional wiring and enhances the effectiveness of the circuit itself, because it reduces or minimizes delay in the detection and suppression of the voltage surges, which lead to arcing.

6. Exemplary Alternatives and Modifications

The above description details certain embodiments, which may be modified or altered in various ways.

For example, the switching element 404 in the described embodiment is a field effect transistor (FET), but could be replaced with a different solid state switching element. The FET 404 may be replaced by a silicon-controlled rectifier (SCR) 404*a*, or a thyristor such as a TRIAC, or an Opto-Electronic Switch 404*b*. The FET may also be replaced with a more complex switching element, such as a solid-state relay. In some cases, this substitution may allow the design to dispense with the voltage protecting diode 403. In addition, use of an optically triggered solid state relay may provide further isolation, especially galvanic isolation, between the control circuit and the suppression path.

Similarly, some embodiments may replace the diode 403 with other devices or methods of rectification and voltage limiting. These could be circuits that combine the diode with resistors or other components or components that use simple switching circuits. However, these alternatives may interfere with the suppression path that is shunting arc-creating voltages from the protected component.

Other alternative embodiments vary the manner in which the circuit is connected to the protected component as shown in FIG. 4. These variations cover inclusion of the inventive concept in switch casings or cable assemblies, as discussed in the preceding section. Some embodiments may be embodied as an independent component with leads for attachment to the input and output terminals 103 and 107, or it may involve other attachment methods/devices. For example, an insulation piercing contact (IPC) would allow the creation of a solid electrical connection to an insulated wire.

The invention can be particularly suited for vehicle wire harness applications connected to a vehicle battery. The wiring harness can be used in various types of vehicles, including vehicles that use an internal combustion engine (ICE) as a power source, vehicles that use an electrical battery as a power source, and hybrid vehicles that use a combination of an ICE and an electrical battery to supply power. Of course other known vehicles can be used, such as hydrogen vehicles, etc. A charging plug or switch for any of the above vehicles (but particularly the electric motor vehicles) can be adapted to include the disclosed apparatus for detecting and suppressing DC electric arcs. Of course, any switch or device that may arc in a vehicle can utilize the disclosed subject matter.

Embodiments are also intended to include or otherwise cover methods of using and methods of manufacturing any or all of the elements disclosed above. The methods of manufacturing include or otherwise cover processors and computer programs implemented by processors used to design various elements of the vehicle energy absorption system disclosed above.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. An apparatus for detecting and suppressing DC electric arcs at a component that connects an electric power source to a load and that is configured to be actuable between an open position that impedes flow of electricity and a closed position that enables flow of electricity, the apparatus comprising:

an input terminal electrically connected to a power source side of the component;

an output terminal electrically connected to a load side of the component;

a detector circuit electrically connected to the input and output terminals so as to be electrically connected in parallel to the component, the detector circuit being configured to detect a significant voltage spike across the component upon the component actuating between open and closed positions, the detector circuit also being configured to transmit a control signal upon detecting the significant voltage spike, the detector circuit including multiple circuit elements, enabling both the detection of the significant voltage spike and the transmission of the control signal, that are directly electrically connected to each other; and a switching circuit that conducts electricity from the power source side of the component to the load side of the component upon receipt of the control signal, wherein the detector circuit includes a diode and a Zener diode, and the Zener diode is directly electrically connected to the diode, the detector circuit includes a capacitor that is directly electrically connected to the input terminal and a resistor that is directly electrically connected to the capacitor at a side opposite from the input terminal, the resistor being directly electrically connected to the output terminal, and the diode is directly electrically connected to the capacitor at the side opposite from the input terminal.

2. The apparatus of claim 1, wherein the significant voltage spike constitutes a voltage sufficient to cause electric arcing within the component.

3. The apparatus of claim 1, wherein the resistor provides at least 10 K Ω impedance.

4. The apparatus of claim 1, wherein the detector circuit includes another resistor directly electrically connected to the Zener diode at a side opposite from the diode, the another resistor being directly electrically connected to the output terminal, such that the another resistor and the Zener diode are in series relative to each other.

5. The apparatus of claim 4, wherein the another resistor provides an impedance that is substantially less than an impedance provided by the resistor.

6. The apparatus of claim 4, wherein the switching circuit includes a solid state triggerable switch that is configured to receive the control signal from the detector circuit, and upon receipt of the control signal, to conduct electricity from the input terminal to the output terminal.

7. The apparatus of claim 6, wherein the solid state triggerable switch is a Field Effect Transistor (FET).

8. The apparatus of claim 6, wherein the switching circuit includes another diode electrically connecting the solid state triggerable switch to the input terminal, the another diode being configured to limit current between the input terminal and the solid state triggerable switch.

9. The apparatus of claim 6, wherein the solid state triggerable switch is a Silicon Controlled Rectifier.

10. The apparatus of claim 6, wherein the solid state triggerable switch is an Opto-Electronic Switch.

11. A method for detecting and suppressing DC electric arcs at a component that connects an electric power source to a load and that is configured to be actuable between an open position that impedes flow of electricity and a closed position that enables flow of electricity, the method comprising:

electrically connecting an input terminal to a power source side of the component;

electrically connecting an output terminal to a load side of the component;

electrically connecting a detector circuit to the input and output terminals so as to be electrically connected in parallel to the component, the detector circuit being configured to detect a significant voltage spike across the component upon the component actuating between open and closed positions, the detector circuit also being configured to transmit a control signal upon detecting the significant voltage spike, the detector circuit including multiple circuit elements including a diode and a Zener diode, enabling both the detection of the significant voltage spike and the transmission of the control signal, that are directly electrically connected to each other, wherein the Zener diode is directly electrically connected to the diode; and conducting electricity from the power source side of the component to the load side of the component upon a switching circuit receiving the control signal, wherein the detector circuit includes a capacitor that is directly electrically connected to the input terminal, and a resistor that is directly electrically connected to the capacitor at a side opposite from the input terminal, the resistor also being directly electrically connected to the output terminal, and the diode is directly electrically connected to the capacitor at the side opposite from the input terminal.

12. The method of claim 11, wherein the switching circuit includes a solid state triggerable switch that is configured to receive the control signal from the detector circuit, and upon receipt of the control signal, to conduct electricity from the input terminal to the output terminal.

13. The method of claim 11, wherein the switching circuit includes another diode electrically connecting the solid state triggerable switch to the input terminal, the another diode being configured to limit current between the input terminal and the solid state triggerable switch.

14. An apparatus for detecting and suppressing DC electric arcs at a component that connects an electric power source to a load and that is configured to be actuable between an open position that impedes flow of electricity and a closed position that enables flow of electricity, the apparatus comprising:

an input terminal electrically connected to a power source side of the component;

an output terminal electrically connected to a load side of the component;

means for detecting electrically connected to the input and output terminals so as to be electrically connected in parallel to the component, the means for detecting being configured to detect a significant voltage spike across the component upon the component actuating between open and closed positions, the means for detecting also being configured to transmit a control signal upon detecting the significant voltage spike, the means for detecting including multiple circuit elements, enabling both the detection of the significant voltage spike and the transmission of the control signal, that are directly electrically connected to each other, the circuit elements include a capacitor that is directly electrically connected to the input terminal, and a diode directly electrically connected to the capacitor at the side opposite from the input terminal, the diode directly connected to a Zener diode; and means for conducting electricity from the power source side of the component to the load side of the component upon receipt of the control signal, wherein the capacitor is directly electrically connected to the input terminal, and a resistor is directly electrically connected to the capacitor at a side opposite from the input terminal, the resistor also being directly electrically connected to the output terminal, and the diode is directly electrically connected to the capacitor at the side opposite from the input terminal.

15. An apparatus for detecting and suppressing DC electric arcs at a component that connects an electric power source to a load and that is configured to be actuatable between an open position that impedes flow of electricity and a closed position that enables flow of electricity, the apparatus comprising:

an input terminal electrically connected to a power source side of the component;

an output terminal electrically connected to a load side of the component;

a detector circuit electrically connected to the input and output terminals so as to be electrically connected in parallel to the component, the detector circuit being configured to detect a significant voltage spike across the component upon the component actuating between open and closed positions, the detector circuit also being configured to transmit a control signal upon detecting the significant voltage spike, the detector circuit including multiple circuit elements, enabling both the detection of the significant voltage spike and the transmission of the control signal, that are directly electrically connected to each other; and a switching circuit that includes a switching element having a gate, the switching circuit configured to conduct electricity from the power source side of the component to the load side of the component upon receipt of the control signal, wherein the detector circuit includes a Zener diode, and the Zener diode is directly electrically connected to the gate of the switching element, the detector circuit includes a capacitor that is directly electrically connected to the input terminal, and a resistor that is directly electrically connected to the capacitor at a side opposite from the input terminal, the resistor also being directly electrically connected to the output terminal, and the detector circuit includes a diode that is directly electrically connected to the capacitor at the side opposite from the input terminal.

* * * * *